US007849526B2

(12) United States Patent
Smith

(10) Patent No.: US 7,849,526 B2
(45) **Date of Patent: *Dec. 14, 2010**

(54) ODORLESS TOILET

(75) Inventor: Robert I. Smith, Dunnellon, FL (US)

(73) Assignee: Smith Innovations, Inc., Dunnellon, FL (US)

( * ) Notice: Subject to any disclaimer, the term of this patent is extended or adjusted under 35 U.S.C. 154(b) by 8 days.

This patent is subject to a terminal disclaimer.

(21) Appl. No.: 11/742,051

(22) Filed: Apr. 30, 2007

(65) Prior Publication Data

US 2008/0022444 A1 Jan. 31, 2008

Related U.S. Application Data

(63) Continuation-in-part of application No. 10/711,824, filed on Oct. 7, 2004, now Pat. No. 7,275,271.

(60) Provisional application No. 60/481,477, filed on Oct. 7, 2003.

(51) Int. Cl.
*E03D 9/05* (2006.01)

(52) U.S. Cl. ..... 4/348; 4/213; 4/216

(58) Field of Classification Search ..... 4/213, 4/216

See application file for complete search history.

(56) References Cited

U.S. PATENT DOCUMENTS 2,985,890 A * 5/1961 Baither ..... 4/213
3,571,822 A * 3/1971 Shaw, Jr ..... 4/213
3,902,203 A 9/1975 Poister et al.
4,318,192 A 3/1982 Williams et al.
4,864,664 A 9/1989 Higgins
5,123,125 A 6/1992 Menge
5,257,421 A * 11/1993 Rose et al. ..... 4/213
5,394,569 A 3/1995 Poirier et al.

(Continued)

FOREIGN PATENT DOCUMENTS

GB 2209356 A 5/1989

(Continued)

OTHER PUBLICATIONS

International Preliminary Report on Patentability with Written Opinion, dated Nov. 12, 2009, received in international patent application No. PCT/US07/20756, 7 pgs.

*Primary Examiner*—Gregory L Huson
*Assistant Examiner*—Karen Younkins
(74) *Attorney, Agent, or Firm*—Holland & Knight LLP; Brian J. Colandreo, Esq.; V. Raman Bharatula, Esq.

(57) ABSTRACT

A toilet is provided which transports malodorous air from the bowl to the sewer line. The tank of the toilet is equipped with a fan which draws air from the bowl through the flush holes, located in the rim of the bowl, into a sealed fan box. An intake tube is used to channel air from the water inlet to the fan box, which leaves the overflow tube unobstructed. Air is diverted out of the fan box through an exit tube which attaches to the siphon at a point behind the water trap. A damper door disposed between the exit tube and intake tube prevents stale air from the siphon or sewer from entering the bowl or tank and escaping.

16 Claims, 6 Drawing Sheets

U.S. PATENT DOCUMENTS 5,575,019 A 11/1996 Kijewski
5,715,543 A * 2/1998 Sim ..... 4/213
6,219,853 B1 * 4/2001 Johnson ..... 4/216
6,983,491 B2 * 1/2006 Curtis et al. ..... 4/216
7,275,271 B1 * 10/2007 Smith ..... 4/213

FOREIGN PATENT DOCUMENTS

GB 2384495 A 7/2003

* cited by examiner

ODORLESS TOILET

CROSS REFERENCE TO RELATED APPLICATIONS

This application is a continuation-in-part of U.S. patent application Ser. No. 10/711,824, filed Oct. 7, 2004; which application claims priority of U.S. Provisional Application 60/481,477, filed Oct. 7, 2003.

BACKGROUND OF THE INVENTION

FIG. 1 illustrates the parts and function of a toilet of the prior art. Toilet 10 includes tank 20 and bowl 12. Tank 20 further includes overflow tube 22, and flapper 24. The normal water level in the tank is also indicated ($W^2$). Bowl 12 further includes flush holes 16 disposed in rim 14. Siphon 18 is disposed at the rear of bowl 12. Water from bowl 12 enters siphon 18 and establishes a water trap which prevents gas from the sewer line from entering bowl 12. The water level within the bowl is indicated ($W^1$).

Water inlet 15 is disposed between tank 20 and bowl 12 and provides fluid communication there between. Specifically, when the toilet is flushed by depressing the flush handle (not shown), flapper 24 is raised and water from tank 20 enters water inlet 15. From water inlet 15, a volume of water travels through rim 14 and enters bowl 12 through flush holes 16. The bulk of the water enters bowl 12 through a large flush hole 16*a* near the rear rim 16.

The large volume of water entering bowl 12 from tank 20 enters quickly and fills siphon 18. Once siphon 18 is filled, suction pulls the water out of bowl 12 and down the sewer pipe (not shown). Once bowl 12 empties, air enters siphon 18 (which produces the distinctive gurgling sound) which stops the siphoning process. Flapper 24 then closes and tank 20 is refilled with water. The flow of water from tank 20 into bowl 12 is shown in FIG. 1 by solid arrows.

SUMMARY OF INVENTION

The invention includes an odorless toilet which transports malodorous air from the bowl to the sewer line. The tank of the toilet is equipped with a fan which draws air from the bowl through the flush holes, located in the rim of the bowl, into a sealed fan box. An intake tube is used to channel air from the water inlet to the fan box, which leaves the overflow tube unobstructed. Air is diverted out of the fan box through an exit tube which attaches to the siphon at a point behind the water trap. A damper door disposed between the exit tube and intake tube prevents stale air from the siphon or sewer from entering the bowl or tank and escaping.

The toilet is powered by a simple fan, such as a 12 v/DC fan connected to a power source. The load required to operate the fan is small and can be supplied by a battery to obviate the need for a hard-wired electrical connection. The fan is activated by a switch positioned to be activated when the flush handle is moved upward. The upward movement of the handle causes the flush arm to move downward and engage the switch. A switch plate engages the flush arm and holds in place, sustaining contact with the switch. When the flush handle is pressed downward, to flush the toilet, the flush arm is raised and loses contact with the switch to deactivate the fan.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
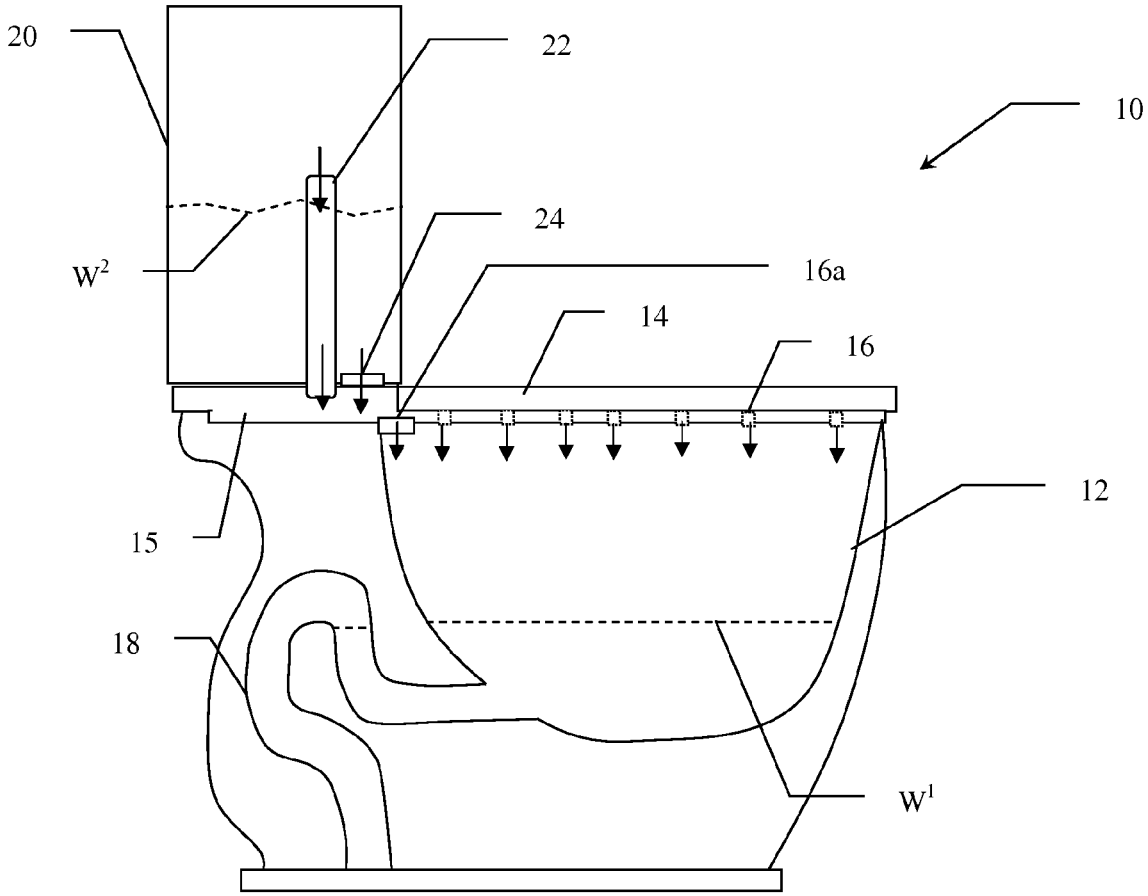
FIG. 1 (Prior Art)
FIG. 1 is a diagram of the toilet of the prior art showing the movement of water from the tank to the bowl (solid arrows).
Figure 2:
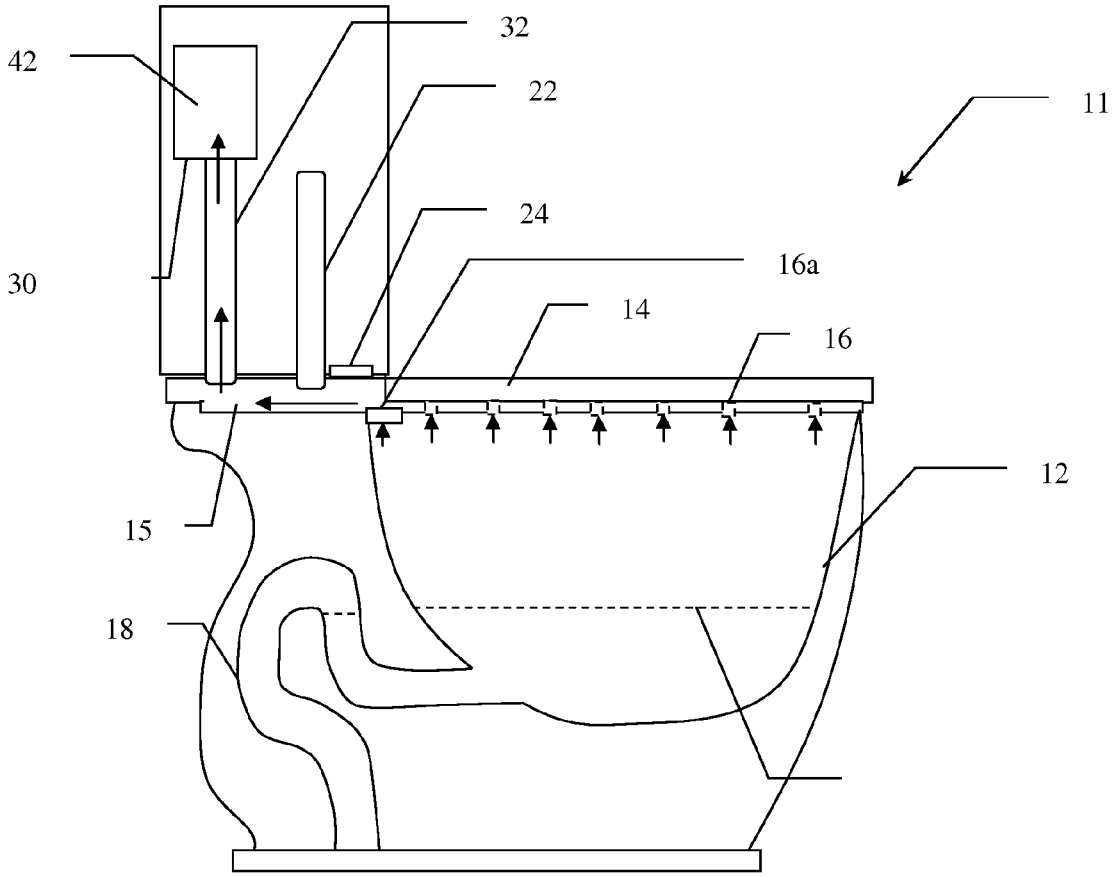
FIG. 2 is a right-side view of the invention showing the path of air (indicated by solid arrows) from the bowl into the fan box.

Referring now to FIG. 2, odorless toilet 11 includes many of the same elements as the prior art. For example, tank 20 has overflow tube 22 and flapper 24. Bowl 12 has flush holes 16 and 16*a* disposed in rim 14; siphon 18 is disposed at the rear of bowl 12. Water inlet 15 provides fluid communication between bowl 12 and tank 20.

Odorless toilet 11 further includes intake tube 32 which connects to water inlet 15, in a similar manner as overflow tube 22. Intake tube 32 is sealed where it meets the bottom of tank 20 to prevent water from leaking into water inlet 15 and bowl 12. Intake tube 32 is attached at its upper end to fan box 30. Fan box 30 remains in fluid communication with bowl 12 through intake tube 32, through water inlet 15 and flush holes 16 and 16*a* in rim 14. A fan (not shown in FIG. 2) in fan box 30 draws air from bowl 12 through flush holes 16 and 16*a* in rim 20, through water inlet 15 and into intake tube 32. Air then enters fan box 30 from intake tube 32. Airflow from bowl 12 to fan box 30 is indicated by solid arrows.

Figure 3:
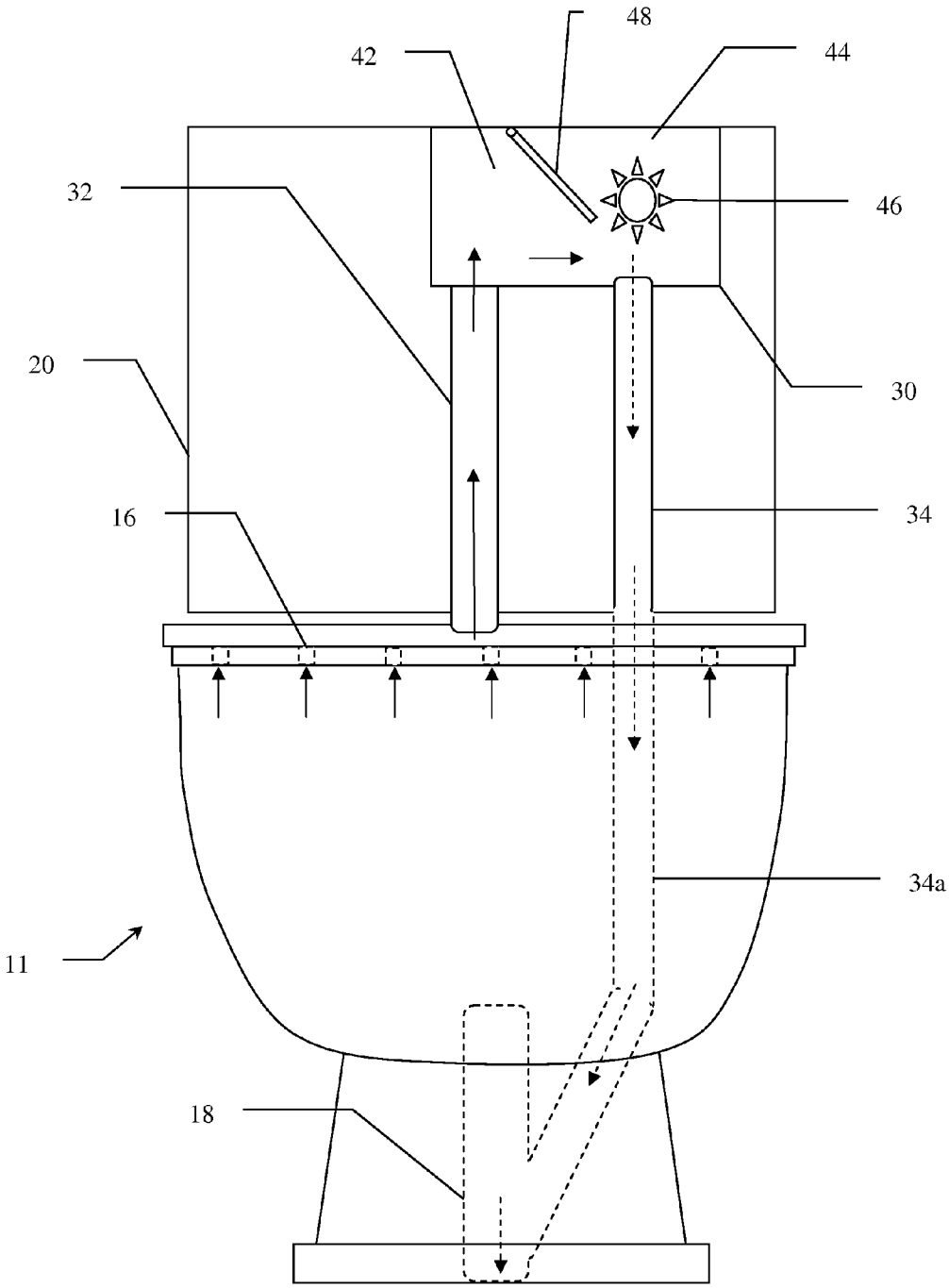
FIG. 3 is a front view of the invention showing the path of air from the bowl into the fan box (solid arrows) and from the fan box to the siphon (hashed arrows).
Figure 4:
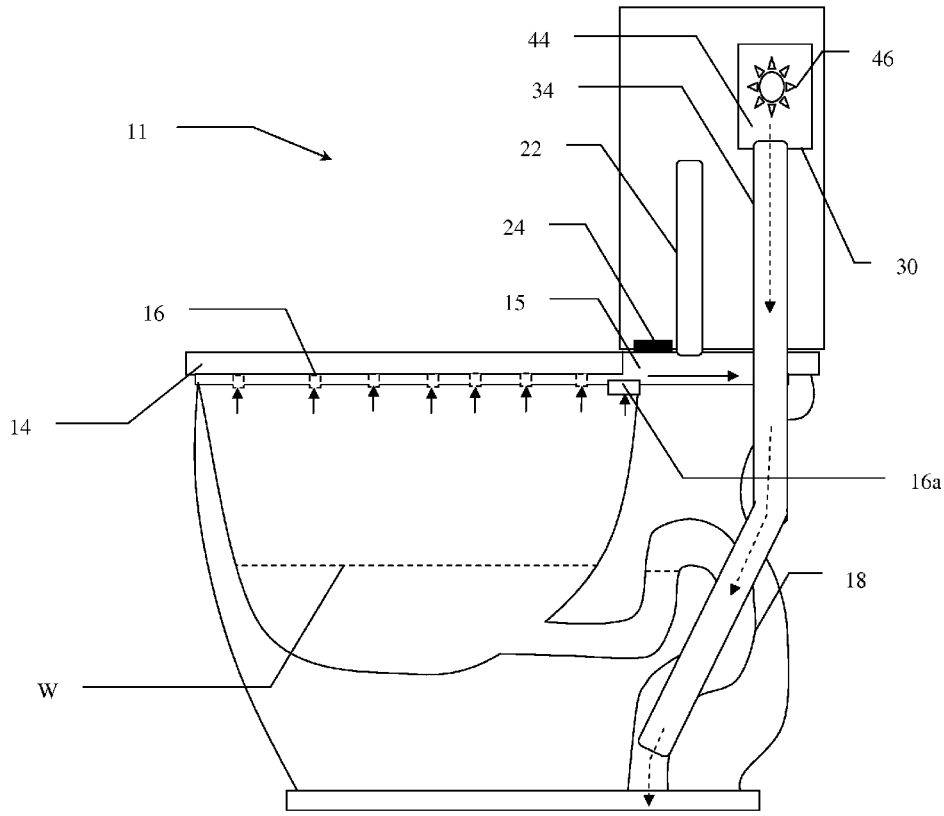
FIG. 4 is a left-side view of the invention showing the path of air from the fan box to the siphon (hashed arrows).

A preferred embodiment of odorless toilet 11 is shown in FIGS. 3 and 4 (the overflow tube and flapper are omitted for ease of viewing in FIG. 3). Exit tube 34 is attached to fan box 30 and provides an egress for air drawn from bowl 12. In the preferred embodiment of FIG. 3, exit tube 34 is attached at its upper end to fan box 30 and to siphon 18 at its lower end. In this manner, air drawn from bowl 12 is transported to the sewer line at a point behind the water trap in siphon 18. Exit tube 34 may have a portion (34*a*) which extends through tank 20 and attaches to siphon 18 externally. The flow of air from bowl 12 to fan box 30 is shown by solid arrows and the flow of air from fan box 30 to siphon 18 is shown by hashed arrows.

Figure 6:
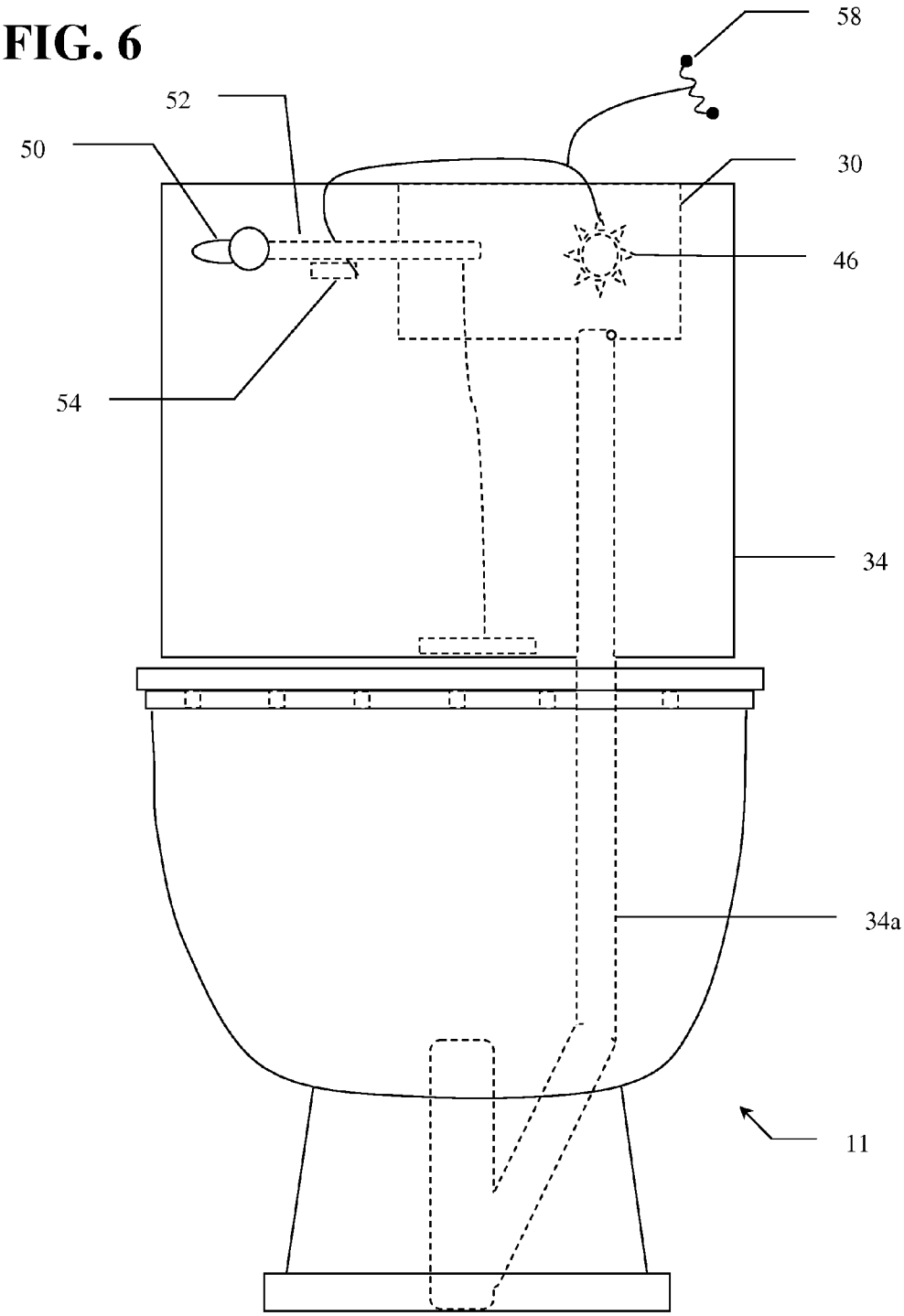
FIG. 6 is a front view of the invention showing the connectivity between the flush handle, switch and fan.

In one embodiment, fan box 30 is divided into air compartment 42 and fan compartment 44 by damper door 48. Fan compartment 44, as its name suggests, houses fan 46. Fan 46 of the preferred embodiment is 12 V/DC fan connected to power source 58 and switch 54 (FIG. 6). However, any mechanism capable of providing a vacuum in fan box 30 sufficient to draw air from bowl 12 can be employed.

Air compartment 42 is in direct-fluid communication with intake tube 32 and fan compartment 44 is in fluid communication with air compartment 42 when fan 46 is activated. Damper door 48 is hingedly connected to fan box 30 thereby defining the compartments and preventing the flow of air from fan compartment 44 to air compartment 42, although air is free to travel from air compartment 42 to fan compartment 44. A biasing means (not shown), such as a common spring, forces damper door 48 closed when fan 46 is not activated. When fan 46 is activated, damper door 48 pivots and allows air to travel from air compartment 42 to fan compartment 44 and out exit tube 34. When fan 46 is deactivated, the resulting back pressure causes damper door 48 to close and form a seal between siphon 18 and bowl 12.

Figure 5:
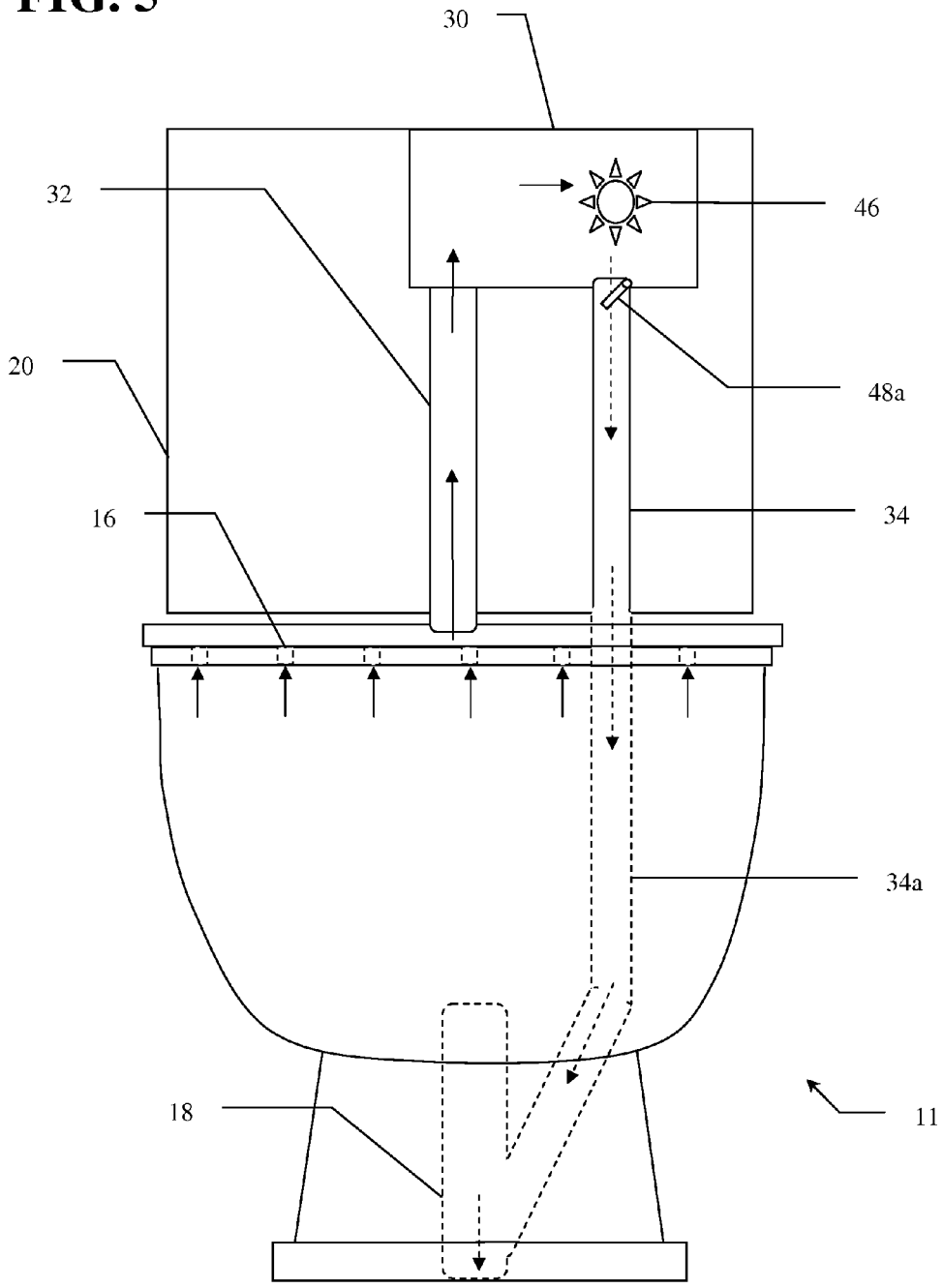
FIG. 5 is a front view of the invention demonstrating an alternative embodiment wherein the damper door is associated with the exit tube.

An alternate embodiment is shown in FIG. 5. Here, fan box 30 is not divided into separate compartments. By placing damper door 48*a* between exit tube 34 and fan box 30, stale air rising from the sewer through siphon 18 is prevented from entering fan box 30 or the ambient air of tank 20. A biasing means (not shown), such as a common spring, forces damper door 48*a* closed when fan 46 is not activated. The precise placement of damper door 48 and/or 48*a* is not critical as long as it is placed along the path of travel between siphon 18 and bowl 12 through fan box 30.

In another embodiment, shown in FIG. 6, the odorless toilet includes a switch adapted to activate the fan when the flush handle is moved upward. Flush handles of the prior art move, generally, from a first position downward to activate the flushing mechanism. Flush handle 50 of odorless toilet 11 is capable of upward movement from its resting position to a first position which completes an electrical circuit, thereby providing power (from source 58) to fan 46. When flush handle 50 is depressed to flush the toilet, the circuit is opened and fan 46 is deactivated.

For example, as shown in FIG. 6, flush handle 50 is attached to flush arm 52 such that movement of flush handle 50 creates a corresponding movement of flush arm 52. Flush arm 52 is connected to flapper 24 by a chain, as with toilets of the prior art. The distal end of flush arm 52 moves upward when flush handle 50 is pressed downward. The distal end of flush arm 52 moves downward, however, and engages switch 54 when flush handle 50 is moved upward.

Switch 54 can be any device capable of closing an electrical circuit. For example, switch 54 may be a plunger type switch, whereby the downward movement of flush arm 52 compresses a plunger that is slidably disposed within a sleeve having a spring which upwardly biases the plunger when flush arm 50 is in the resting position. A contact bar is pivotally fastened within a housing and is pivoted against a microswitch by the downward force of the plunger. The microswitch closes the circuit and activates the fan. Switches capable of closing the circuit in a similar manner are well known within the art.

Odorless toilet 11 can further be equipped with switch plate which has a protrusion adapted to releaseably engage flush arm 52 when flush handle 50 is raised. This ensures the circuit remains completed and power is supplied to the fan until flush handle 50 is depressed.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A toilet, comprising:

a tank;

a bowl;

a siphon;

an overflow tube, distinct from an intake tube, extending through a bottom of the tank and into a water inlet;

a rim having a plurality of flush holes;

the water inlet adapted to provide fluid communication between the tank, flush holes and the bowl;

a fan box disposed in the tank;

the intake tube, distinct from the overflow tube, extending from the fan box, through the bottom of the tank and into the water inlet, whereby the intake tube is sealed to prevent water from being fluidly communicated from the tank into the water inlet while providing fluid communication between the fan box and the water inlet; and a fan disposed within the fan box, wherein operation of the fan draws air from the bowl into the water inlet, through the intake tube and into the fan box.

2. The toilet of claim 1 wherein air from the bowl is drawn into the water inlet through the flush holes.

3. The toilet of claim 1 further comprising:

an exit tube having a first end and a second end;

wherein the exit tube is connected to the fan box at its first end; and whereby operation of the fan expels air in the fan box through the exit tube at its second end.

4. The toilet of claim 3 wherein the second end of the exit tube is connected to the siphon.

5. The toilet of claim 1, further comprising:

a flush handle having at least a first position and a second position;

a flush arm connected to the flush handle whereby movement of the flush handle causes a corresponding movement of the flush arm; and a switch adapted to activate the fan when the flush handle is moved to the first position.

6. The toilet of claim 5 wherein the switch further comprises a switch plate adapted to contact the flush arm when the flush handle is moved to the first position;

whereby the contact of the flush arm and the switch completes an electric circuit and activates the fan.

7. The toilet of claim 6 wherein the movement of the flush handle to the second position causes the flush arm to lose contact with the switch and deactivate the fan.

8. A toilet, comprising:

a tank;

a bowl;

a siphon;

an overflow tube, distinct from an intake tube, extending through a bottom of the tank and into a water inlet;

a rim having a plurality of flush holes;

the water inlet adapted to provide fluid communication between the tank, flush holes and the bowl;

a fan box including an air compartment and a fan compartment;

the intake tube, distinct from the overflow tube, extending from the air compartment, through the bottom of the tank and into the water inlet, whereby the intake tube is sealed to prevent water from being fluidly communicated from the tank into the water inlet while providing fluid communication between the air compartment and the water inlet;

the fan compartment being in fluid communication with the air compartment;

a fan disposed within the fan compartment, wherein operation of the fan draws air from the bowl into the fan compartment; and an exit tube having a first end and a second end; wherein the exit tube is connected to the fan compartment at its first end; and whereby operation of the fan expels air in the fan box through the exit tube at its second end; and wherein the second end of the exit tube is connected to the siphon.

9. The toilet of claim 8 wherein air from the bowl is drawn into the water inlet through the flush holes.

10. The toilet of claim 8, further comprising a door hingidly disposed between the fan compartment and the air compartment, whereby air in the fan compartment is prevented from moving to the air compartment.

11. The toilet of claim 8, further comprising:

a flush handle having at least a first position and a second position;

a flush arm connected to the flush handle whereby movement of the flush handle causes a corresponding movement of the flush arm; and a switch adapted to activate the fan when the flush handle is moved to the first position.

12. The toilet of claim 11 wherein the switch further comprises a switch plate adapted to contact the flush arm when the flush handle is moved to the first position; whereby the contact of the flush arm and the switch completes an electric circuit and activates the fan.

13. The toilet of claim 11 wherein the movement of the flush handle to the second position causes the flush arm to lose contact with the switch and deactivate the fan.

14. A toilet, comprising:

a tank;

a bowl;

a flush handle having at least a first position and a second position;

a flush arm connected to the flush handle whereby movement of the flush handle causes a corresponding movement of the flush arm;

a siphon;

an overflow tube, distinct from an intake tube, extending through a bottom of the tank and into a water inlet;

a rim having a plurality of flush holes;

the water inlet adapted to provide fluid communication between the tank, flush holes and the bowl;

a fan box disposed in the tank;

the intake tube, distinct from the overflow tube, extending from the fan box, through the bottom of the tank and into the water inlet, whereby the intake tube is sealed to prevent water from being fluidly communicated from the tank into the water inlet while providing fluid communication between the fan box and the water inlet;

a fan disposed within the fan box, wherein operation of the fan draws air from the bowl into the water inlet and into the fan box through the intake tube; and a switch adapted to activate the fan when the flush handle is moved to the first position.

15. The toilet of claim 14 wherein the switch further comprises a switch plate adapted to contact the flush arm when the flush handle is moved to the first position; whereby the contact of the flush arm and the switch completes an electric circuit and activates the fan.

16. The toilet of claim 14 wherein the movement of the flush handle to the second position causes the flush arm to lose contact with the switch and deactivate the fan.

* * * * *